US005429031A

United States Patent [19]

Merendino

[11] Patent Number: 5,429,031

[45] Date of Patent: Jul. 4, 1995

[54] LIGHT WEIGHT ARMOR

[75] Inventor: Alfred B. Merendino, Baltimore, Md.

[73] Assignee: The United States of America as represented by the Secretary of the Army, Washington, D.C.

[21] Appl. No.: 358,251

[22] Filed: May 2, 1973

[51] Int. Cl.[6] ..... F41H 5/04

[52] U.S. Cl. ..... 89/36.02

[58] Field of Search ..... 89/36 R, 36 A, 36 H, 89/36.01, 36.02, 36.08; 114/12, 14; 109/80, 82, 84, 85; 29/191.4, 196.2

[56] References Cited

U.S. PATENT DOCUMENTS

| | | | |
|---|---|---|---|
| 2,380,393 | 7/1945 | Berg | 89/36 H |
| 3,042,555 | 7/1962 | George et al. | 89/36 A |
| 3,351,374 | 11/1967 | Forsyth et al. | 89/36 H |
| 3,765,301 | 10/1973 | Pagano et al. | 89/36 H |

FOREIGN PATENT DOCUMENTS

| | | | |
|---|---|---|---|
| 1098412 | 1/1961 | Germany | 89/36 H |
| 122370 | 1/1919 | United Kingdom | 89/36 A |

*Primary Examiner*—Stephen C. Bentley

*Attorney, Agent, or Firm*—Freda L. Krosnick; Muzio B. Roberto

[57] ABSTRACT

A light weight armor comprising alternate layers of a high and lower density medium.

2 Claims, 5 Drawing Sheets

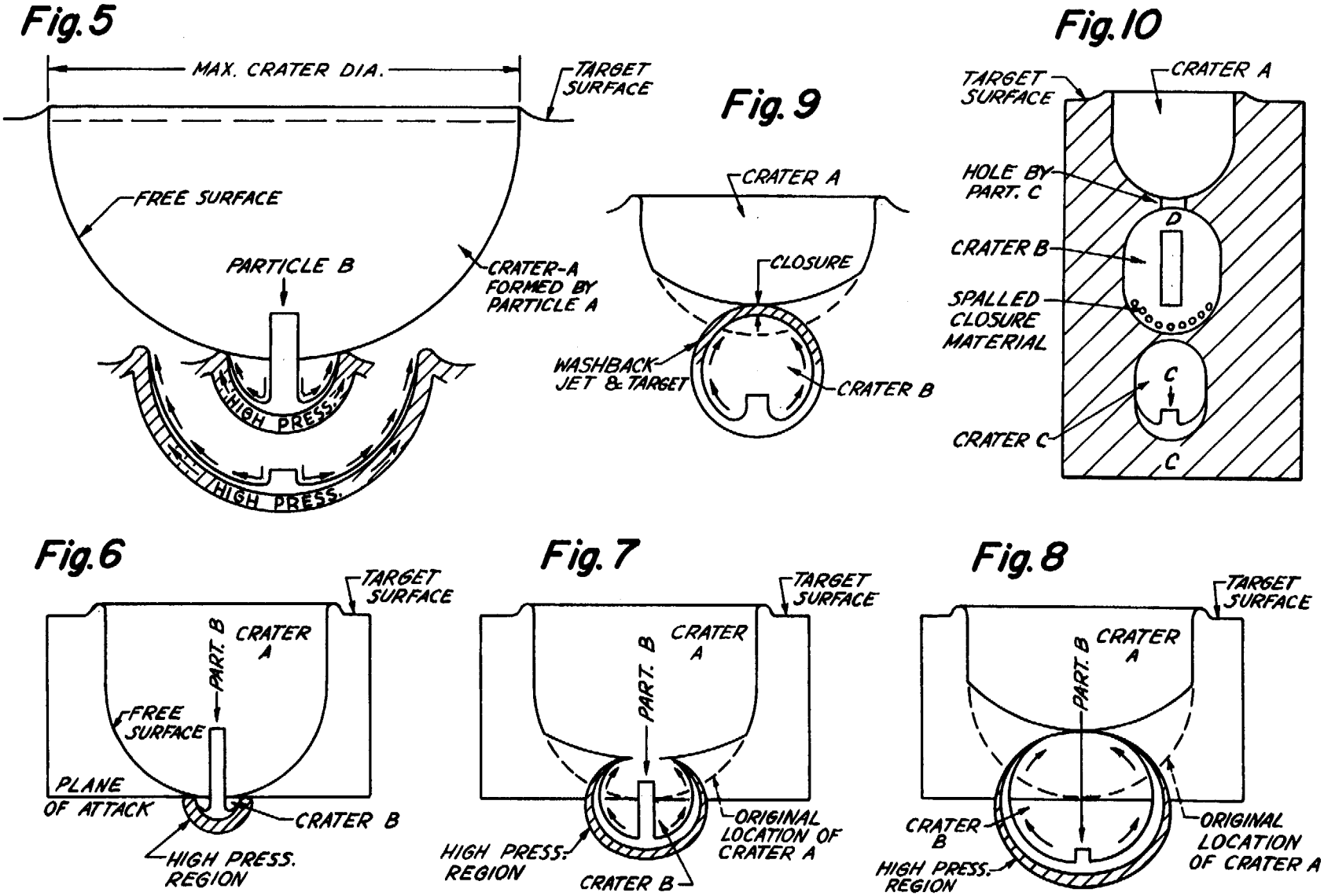
Fig. 10
CRATER A
TARGET SURFACE
HOLE BY PART. C
CRATER B
SPALLED CLOSURE MATERIAL
CRATER C
Fig. 9
CRATER A
CLOSURE
CRATER B
WASHBACK JET & TARGET
Fig. 5
TARGET SURFACE
MAX. CRATER DIA.
CRATER-A FORMED BY PARTICLE A
PARTICLE B
FREE SURFACE
HIGH PRESS.
HIGH PRESS.
Fig. 8
TARGET SURFACE
ORIGINAL LOCATION OF CRATER A
CRATER A
PART B
CRATER B
HIGH PRESS. REGION
Fig. 7
TARGET SURFACE
ORIGINAL LOCATION OF CRATER A
CRATER A
PART B
CRATER B
HIGH PRESS. REGION
Fig. 6
TARGET SURFACE
CRATER B
CRATER A
PART B
FREE SURFACE
HIGH PRESS. REGION
PLANE OF ATTACK

LIGHT WEIGHT ARMOR

The invention described herein may be manufactured, used, and licensed by or for the Government for governmental purposes without the payment to me of any royalty thereon.

This invention relates to a light weight armor system and more particularly to a light weight armor comprising alternate layers of a high and lower density medium.

The only practical method for protecting military targets against shaped charge and armor piercing projectiles has been the use of high strength steel plates. However, recent development in both shaped charge and armor piercing projectile technology have demanded the use of progressively thicker steel plates to the point that the weight of the necessary steel becomes prohibitive.

Several light weight armor concepts have been proposed in the past and many have been tested, but for various reasons have always been considered impractical. Some were too thick, i.e., bulky. Others required that the attach be oblique, while others could not survive a single attack to provide protection for a second shot. An acceptable armor system must be light in weight, not excessively thick, and able to withstand multiple attacks, and still provide protection against both shaped charge and armor piercing projectile attacks.

The present armor system utilizes alternate layers of a high and lower density material such as steel and air in order to defeat a shaped charge and armor piercing projectile attack so as to exploit two armor response mechanisms recently discovered by the inventor, which will be discussed later.

It is an object of the present invention to provide and disclose a novel armor system comprising alternate layers of high and lower density materials.

It is a further object of the present invention to provide and disclose a novel armor system comprising alternate layers of high and lower density materials, which is equal to the protection provided by conventional monolithic steel armor, but significantly lighter in weight.

It is a further object of the prevent invention to provide and disclose a novel armor system which does not depend on the obliquity of attack for its protective capability.

It is a further object of the present invention to provide and disclose an armor system which will maintain its protective features for multiple hits provided that each succeeding hit is in a new location.

Other objects and a fuller understanding of the invention may be had by referring to the following description and claims taken in conjunction with the accompanying drawing in which:

FIG. 5 is an illustration of the particulate penetration of the target after maximum diameter initial crater is achieved.

FIG. 6 is an illustration of the reaction of a target material to succeeding particulate jet attack to develop a secondary crater.

FIG. 7 is an illustration of the further development of the secondary crater of FIG. 6.

FIG. 8 is an illustration of the further development of the secondary crater of FIG. 7.

FIG. 9 is an illustration of wash back material deposited at the top surface of a secondary crater.

FIG. 10 is an illustration of the effects of closure on succeeding jet particles.

Figure 1:
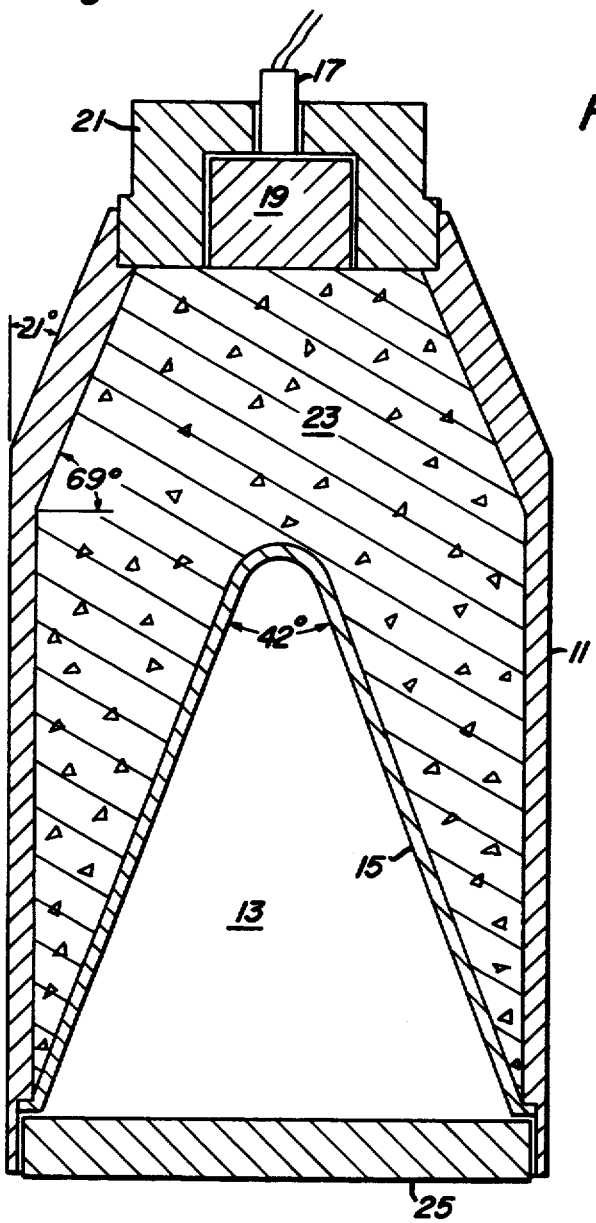
FIG. 1 is a sectional view of an exemplary shaped charge.

The present invention may be illustrated by referring to FIG. 1 which shows a shaped charge warhead. Said shaped charge comprises housing 11 having a cylindrical configuration with a reduced upper portion and cavity 13 at the other end. The cavity is lined with any suitable material, e.g., copper, designated 15. Detonator 17, booster 19 and detonator and booster adaptor 21 are positioned at the rear of the shaped charge. Explosive 23 which is positioned in the interior of the housing 11 is detonated on the axis of symmetry at the end opposite cavity 13. The detonation of the explosive sweeps along the cavity liner and collapses it on its axis. At this point a "jet" of penetrant, i.e., copper, is generated along the axis. Because of the extremely high rate of detonation involved (7 mm/μsec) the leading portion of the jet has velocity of about the same value. However, the following parts of the jet move at progressively lower velocities. This velocity gradient is induced because as the detonation sweeps along the liner axis, the mass per unit length of the liner increases exponentially and the amount of explosive available to move this mass decreases. Hence the liner material moves toward the axis at lower velocities and consequently generates jet at lower velocities.

Figure 2:
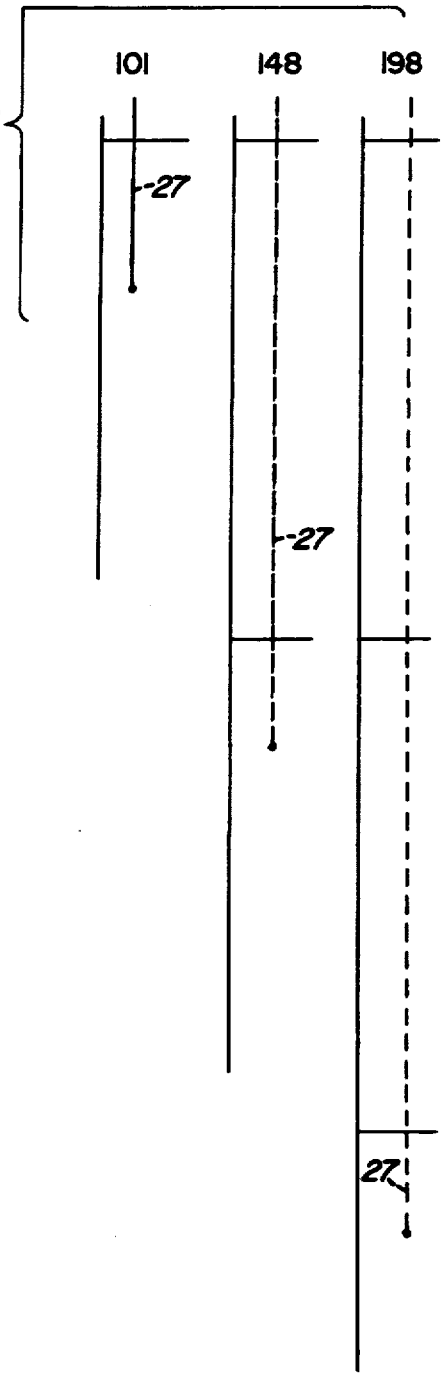
FIG. 2 is an illustrative radiograph of a copper jet taken at three different times, i.e. μs, after warhead initiation.

The presence of the velocity gradient in the jet leads to a weakness in the jet that is exploited by the armor concept described here. Since the leading parts of the jet are moving faster than the following parts, the jet draws itself out in length and ultimately exceeds its limit of ductility. The jet designated 27, separates into a stream of particles as shown in FIG. 2. When the jet attacks monolithic armor in this partiuclate form, the target reacts in a fashion different from its reaction to a continuous jet.

When the jet impacts a material, the pressure exerted, because of the high velocity, are orders of magnitude above the yield strengths of armor steels. Consequently, both the jet and armor flow plastically. If one used Bernouilli's equation to express the pressure at the jet/armor interface them:

$$\tfrac{1}{2}\rho_j(V_j-U)^2=\tfrac{1}{2}\rho_a U^2$$

where $\rho_j$=density of jet material $V_j$=velocity of jet

U=rate at which jet penetrates the armor $\rho_a$=density of the armor

To demonstrate the concept of this mode of penetration, a simplified example is used. Consider a jet of length l, all parts of which are moving at the same velocity, i.e., $V_j$, and hence the penetration velocity, i.e., U, will be constant. Then, penetration is given by the equation:

$$P = U\Psi \tag{2}$$

where t = the time of penetration.

Since l is the jet length $$t = \frac{l}{(V - U)} \tag{3}$$

and therefore $$P = \frac{l}{(V - U)} U \tag{4}$$

and hence, using $\frac{U}{(V - U)} = \sqrt{\frac{\rho_j}{\rho_a}}$ from Equation 1

$$P = l\sqrt{\frac{\rho_j}{\rho_a}} \tag{5}$$

The depth of penetration depends on the length and density of the jet and not on its velocity. Furthermore, the depth of penetration depends inversely on the density of the armor material.

The present invention exploits two armor response mechanism recently discovered by the inventor which are designated "jet foreshortening" and "closure". Jet foreshortening is a mechanism by which the jet length is consumed by the armor at an unusually high rate while the jet is continuous. Closure, on the other hand is a mechanism that uses up the jet length at an unusually high rate after the jet is particulate.

Jet foreshortening occurs in the leading part of the jet as it emerges from penetrating a discreet thickness of material, e.g., a steel plate, into a medium of lower density, e.g., air. In principle, the length of jet required to penetrate the higher density material should comprise the only loss of jet length (the density of air is considered negligible for purposes of explaining the phenomenon). However, copper jets have been observed radiographically to continue to lose jet length at an excessively high rate immediately upon emerging from steel plates into air. The same effect has been observed to a lesser degree utilizing aluminum as the medium of lower density.

During penetration, the tip of the jet in contact with the target and some finite length of jet behind the tip is highly stressed because of the pressure exerted at the jet-target interface. As long as the jet continues to penetrate armor material, the induced stresses do not have sufficient time to have a significant influence on the jet. When the jet emerges from the armor into a much lower density material, the influence of the stresses become apparent in the behavior of the jet. The jet continues to flow laterally at a rate much higher than that which would be expected from hydrodynamic considerations for a jet penetrating a lower density material. The stresses in the jet near the jet-target interface are sufficiently high so that the jet temperature is raised to the vicinity of its melting point. Finally, a flow pattern, established during the penetration of the plates, continues after emergence. All three conditions, i.e., high internal stress, high temperature and established flow pattern, contribute to the foreshortening.

Figure 3:
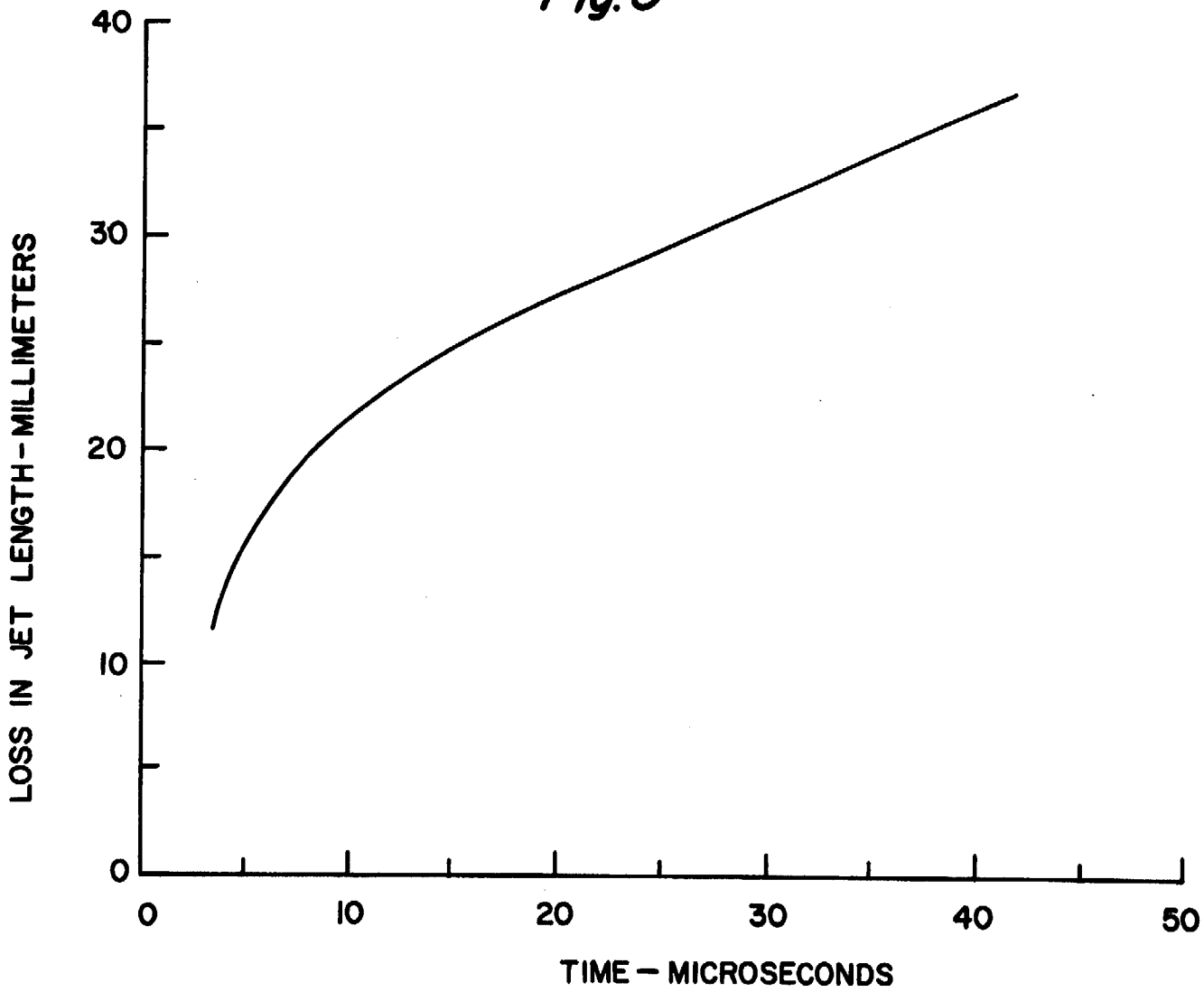
FIG. 3 is a graph illustrating loss in jet length versus time after emerging from a steel plate.

Measurements of jet length loss have been made on copper jets emerging over a range of steel plate thicknesses of between 0.312 and 2.0" and for shaped charge diameters between 3.0 to 5.0". These measurements are summarized in the curve in FIG. 3. The jet length loss as a function of time is independent of both charge size and plate thickness over the range of sizes and thicknesses indicated. Implicit in this data is the fact that the jet length loss is also independent of the velocity of the emerging jet since varying the plate thickness also varies the velocity.

Figure 4:
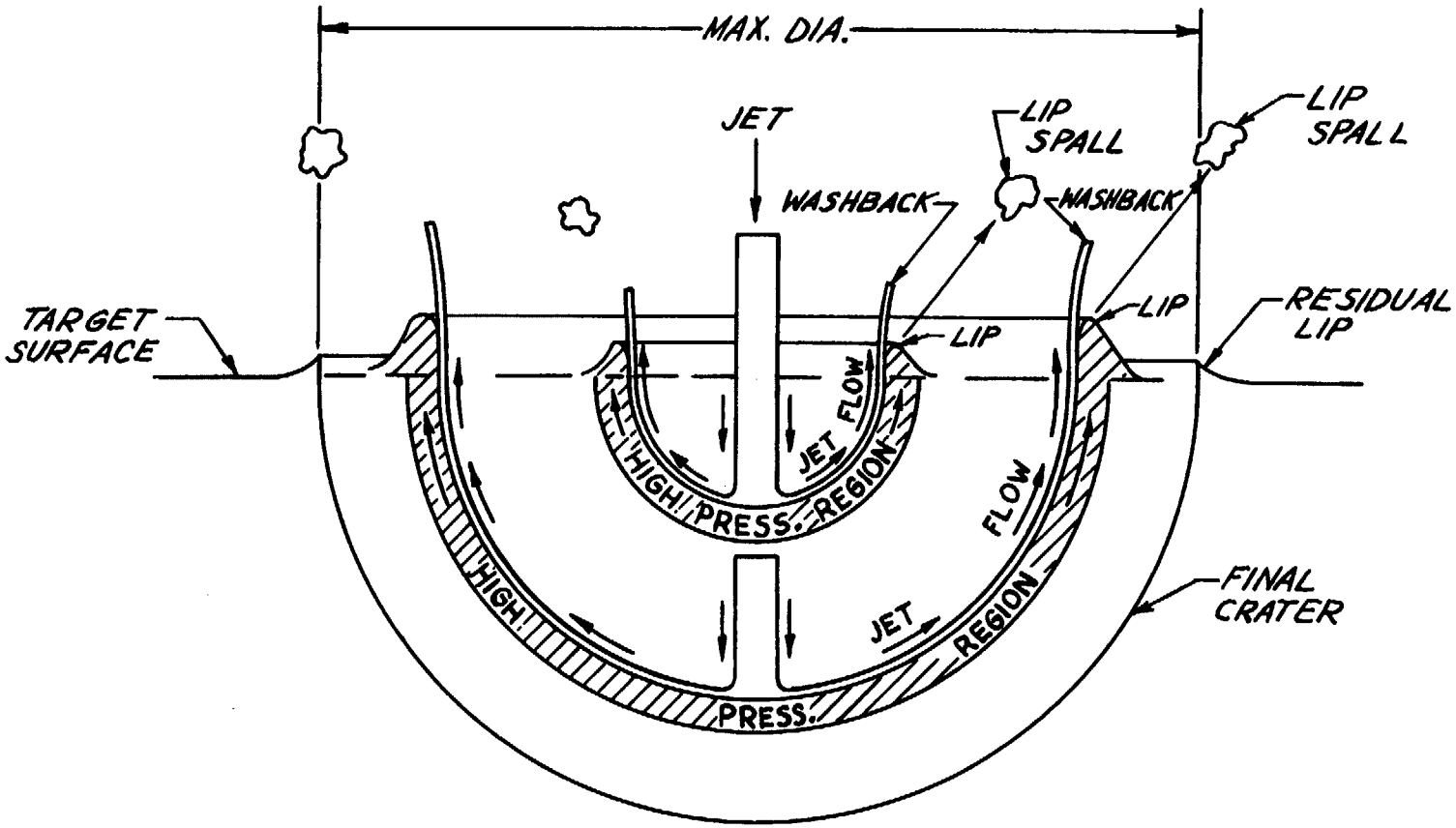
FIG. 4 is an illustration of the reaction of a target surface to a continuous jet attack.

Consider a continuous jet as it encounters a target surface as illustrated in FIG. 4. While the jet is forming the initial crater, a high pressure region develops in the target below flowing jet material. At the target surface or "free surface" there are no opposing forces; therefore, a release of pressure will result, causing target material to rise above the surface forming a "lip". The material in the lip will rise at a high velocity, break away from the target surface, and continue on as spall particles. Also, there is some target and jet material ejected out of the crater due to "wash back" action by the jet.

In order to illustrate the reaction of a target to a particulate jet attack, consider a particulate jet with the lead particle identified as A and succeeding particles similarly identified in alphabetical order. Consider further that particle A has formed a crater and that particle B is in the process of forming a crater as shown in FIG. 5. The surface of crater A is a "free surface" when it is encountered by particle B, i.e., it is not loaded by flowing jet material as in the case of continuous penetration process as illustrated in FIG. 4. However, as the crater produced by particle B develops, the upper limits of the crater sees the free surface for only a very short distance due to the concavity of crater A. Therefore, initially particle B will form a small hemispherical crater (B) in the bottom of crater A along with a high pressure region below it as shown in FIG. 6. As crater B develops, more and more target material is present between the plane of attack and the free surface of crater A. Therefore, instead of the high pressure region releasing at a metal-gas interface and forming a lip, it is kept contained in a metal-metal system. The result is that the bottom surface of crater A is displaced upward by the pressure developed in the material just below it, and that this motion will partially or completely close the opening initially made in crater A by particle B as in FIGS. 7 and 8.

It is considered that at the same time that the crater displacement process takes place there is also some "wash-back" of the target material. Washed-back target material is defined as that which is carried along and ejected from the crater by the flowing jet material. Along with this target material, there must also be some jet material. Since the bottom of crater A forms a closure, then wash-back material from B will be contained within the confines of crater B and some of this material will be deposited along the top surface of the crater adding to the thickness of the closure as illustrated in FIG. 9.

As soon as a closure forms, an obstruction is presented to the next jet particle as shown in FIG. 10. Particle D must now penetrate a closure before it can reach the bottom of crater C and add to the depth of the penetration. The result will be that particle D will lose some length and spall some closure material toward the bottom of crater C. In addition, particle D will leave a small hole in the closure formed by particle C. Succeeding particles will repeat the process until all closures are formed which will be at or near the time the maximum penetration is obtained.

Figures 11, 12, 13:
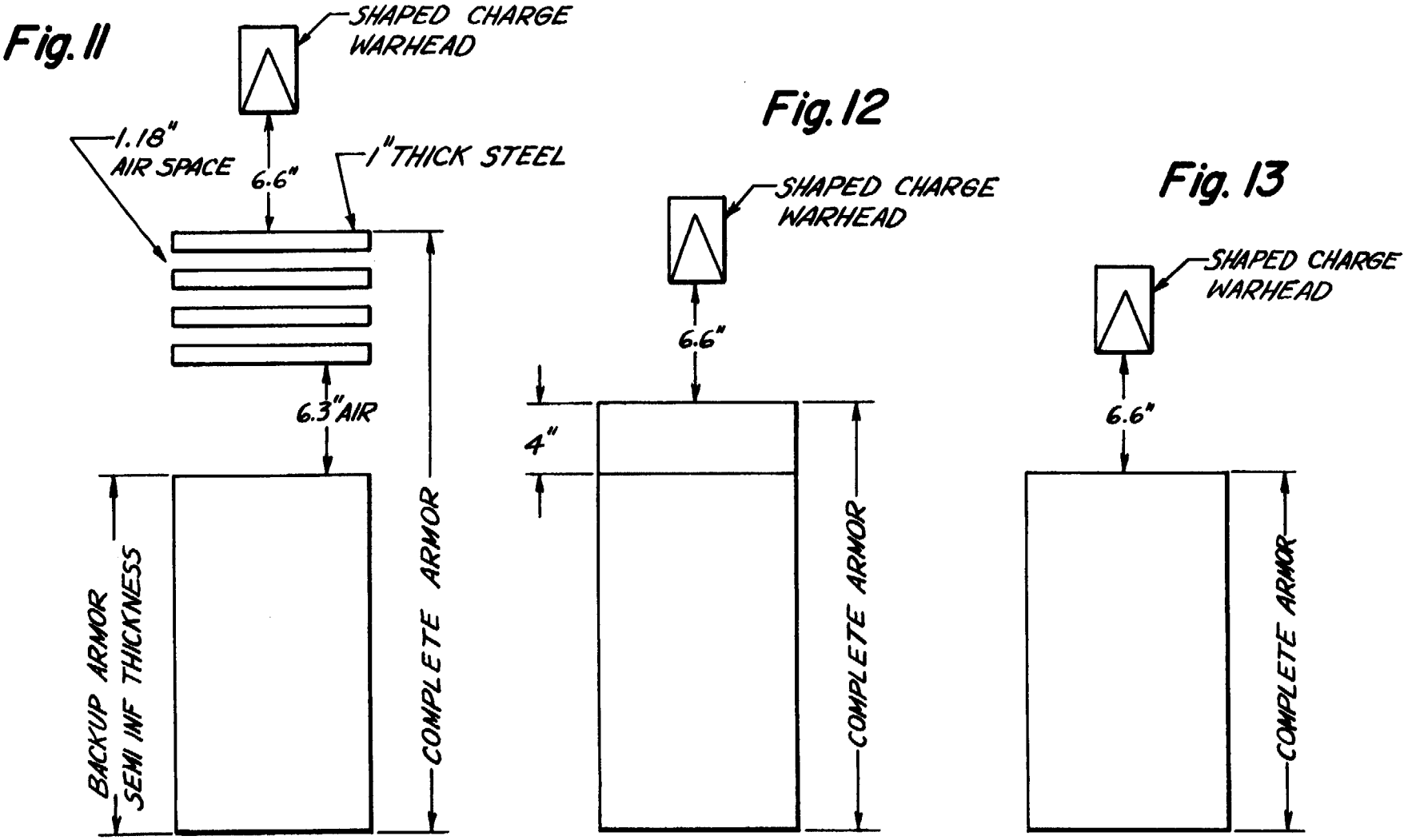
FIG. 11 is an illustration of an experimental system utilized to evaluate the present armor system against a shaped charge warhead.
FIG. 12 is an illustration of an experimental system utilized to evaluate an alternative of the armor system of FIG. 11.
FIG. 13 is an illustration of an experimental system utilized to evaluate a solid steel target.

Three armor designs illustrated in FIGS. 11, 12 and 13 were evaluated against a shaped charge 3.3" in diameter. The armor system of FIG. 11 comprised 4 steel plates separated by alternate air spaces. A solid backup material, i.e., aluminum alloy 2024-T4 having a hardness of 140 was positioned at the rear of the system. Aluminum alloy 2024 comprises 4.4% copper, 0.6% maganese, 1.5% magnesium and remainder aluminum plus a small amount of impurities. The air spaces in the armor provided the low density medium to allow foreshortening to take place. The residual armor, i.e., aluminum alloy 2024, provided the closure forming material. The evaluation was repeated utilizing aluminum alloy 7075-T6 having a hardness of 180. Aluminum alloy 7075-T6 comprises 1.6% copper, 2.5% magnesium, 0.30% chromium, 5.6% zinc, and the remainder aluminum and a small amount of impurities.

The alternate armor system of FIG. 12 consisted of a 4" thick steel plate component having a BHN hardness of 360 to which was attached residual armor material composed of 2024 material having a BHN hardness of 140.

The armor material of FIG. 13 consisted of a solid steel target having a BHN hardness of 280.

From the results of the shaped charge firings, a comparison of armor areal density and thickness required to defeat the shaped charge warhead can be made between the two composite armors, i.e., FIGS. 11 and 12, and the solid steel armor, i.e., FIG. 13, as set forth in Table 1 below:

TABLE I

| Armor Illustration | Backup Armor Material | Penetration Into Backup Armor (In.) | Complete Armor Areal Density (Lb/ft$^2$) | Complete Armor Thickness (in.) |
|---|---|---|---|---|
| FIG. 11 | 2024-T4 | 11.6 | 317 | 25.5 |
| FIG. 12 | 2024-T4 | 15.2 | 373 | 19.2 |
| FIG. 13 | Steel | 15.3 | 612 | 15.3 |

In addition the evaluation of the armor system of FIGS. 11 and 12 was carried out utilizing 7075-T6 as the backup material in lieu of 2024-T4. A comparison of the results obtained are set forth in Table II below:

TABLE II

| Armor Illustration | Backup Armor Material | Penetration Into Backup Armor (In.) | Complete Armor Areal Density (Lb/ft$^2$) | Complete Armor Thickness (in.) |
|---|---|---|---|---|
| FIG. 11 | 7075-T6 | 9.6 | 289 | 23.5 |
| FIG. 12 | 7075-T6 | 13.2 | 345 | 17.2 |

For the composite armors utilizing alloy 2024-T4 backup material illustrated in FIGS. 11 and 12, areal density reductions of 48 and 39%, respectively, were realized when compared with the solid steel armor of FIG. 13. Increases in Armor thickness of 67 and 26%, respectively, were obtained. Similar results were obtained with the utilization of 7075-T6 as the backup material.

The composite armor shown in FIG. 11 was evaluated against U.S. and U.K. 105 millimeter A.P.D.S. projectiles. The 105 mm gun was positioned at a distance of 175 yards from the target. The results are set forth in Table III below:

TABLE III

| Armor | Backup Armor Material | Warhead Design | Penetration Into 2024-T4 Backup Armor (In.) |
|---|---|---|---|
| FIG. 11 | 2024-T4 | US 105 mm APDS | 4.0 |
| FIG. 11 | 2024-T4 | UK 105 mm APDS | 9.5 |

Thus it is apparent that the present armor system provides adequate protection against both shaped charges and kinetic energy warheads. The present armor may be used to provide protection for tanks, personnel carriers, bunkers, boats, ships, aircraft or other targets which may be subjected to shaped charges or kinetic energy warhead attack. The armor design is basically simple in construction, so that adapting it to various targets should not present any problems.

Although I have described my invention with a certain degree of particularity, it is understood that the present disclosure has been made only by way of example and that numerous changes in the details of construction and the combination and arrangement of parts may be resorted to without departing from the spirit and the scope of the invention as hereinafter claimed.

Having described my invention, I claim:

1. An armor system for defeating shaped charges, said system comprising a high-strength low-density aluminum armor plate and, forwardly disposed therefrom, a series of steel armor plates separated by air spaces from each other and from said aluminum armor plate, said steel armor plates and said aluminum armor plate being substantially parallel to each other.

2. An armor system in accordance with claim 1 consisting of four steel plates.

* * * * *